US009061868B1

(12) United States Patent
Paulsen et al.

(10) Patent No.: US 9,061,868 B1
(45) Date of Patent: Jun. 23, 2015

(54) VACUUM-ASSISTED CARTON OR BOX LIFTER

(71) Applicant: WEPCO, Inc., Pittston, PA (US)

(72) Inventors: Christopher Paulsen, Binghamton, NY (US); Tyler Brownlow, Friendsville, PA (US)

(73) Assignee: Wepco., Inc., Pittston, PA (US)

( * ) Notice: Subject to any disclaimer, the term of this patent is extended or adjusted under 35 U.S.C. 154(b) by 64 days.

(21) Appl. No.: 13/933,229

(22) Filed: Jul. 2, 2013

Related U.S. Application Data

(60) Provisional application No. 61/673,427, filed on Jul. 19, 2012.

(51) Int. Cl.
*B66C 1/02* (2006.01)
*B66C 23/18* (2006.01)
*B66C 13/18* (2006.01)

(52) U.S. Cl.
CPC . *B66C 23/18* (2013.01); *B66C 1/02* (2013.01); *B66C 1/0218* (2013.01); *B66C 13/18* (2013.01)

(58) Field of Classification Search
USPC ..... 414/627, 814; 294/183, 185, 65, 64.1, 294/67.5, 186, 188, 189; 254/264, 266, 254/273, 275
See application file for complete search history.

(56) References Cited

U.S. PATENT DOCUMENTS

| | | | | | |
|---|---|---|---|---|---|
| 4,413,853 | A * | 11/1983 | Andersson | 294/186 |
| 4,557,659 | A * | 12/1985 | Scaglia | 414/627 |
| 4,850,782 | A * | 7/1989 | Focke | 414/793 |
| 5,088,878 | A * | 2/1992 | Focke et al. | 414/627 |
| 5,330,314 | A * | 7/1994 | Bennison | 414/627 |
| 5,431,469 | A | 7/1995 | Ohno et al. | |
| 5,816,635 | A * | 10/1998 | Jansson | 294/186 |
| 5,865,426 | A * | 2/1999 | Kazerooni | 254/270 |
| 5,915,673 | A * | 6/1999 | Kazerooni | 254/270 |
| 6,345,850 | B1 * | 2/2002 | Foust | 294/189 |
| 6,367,855 | B1 * | 4/2002 | Schmalz et al. | 294/186 |
| 6,386,513 | B1 * | 5/2002 | Kazerooni | 254/270 |
| 6,622,990 | B2 * | 9/2003 | Kazerooni | 254/270 |
| 6,634,621 | B2 | 10/2003 | Keith | |
| 6,652,014 | B2 * | 11/2003 | Schmalz et al. | 294/65 |
| 6,802,688 | B1 * | 10/2004 | Andersen et al. | 414/796.2 |
| 6,886,812 | B2 * | 5/2005 | Kazerooni | 254/270 |
| 7,559,533 | B2 * | 7/2009 | Stockmaster et al. | 254/270 |
| 8,070,203 | B2 * | 12/2011 | Schaumberger | 294/183 |
| 8,272,672 | B2 * | 9/2012 | Huecker et al. | 294/67.5 |
| 8,473,094 | B2 * | 6/2013 | Becker et al. | 700/213 |
| 2003/0143062 | A1 * | 7/2003 | Bennison | 414/627 |
| 2010/0176613 | A1 * | 7/2010 | Huecker et al. | 294/67.5 |

* cited by examiner

*Primary Examiner* — Kaitlin Joerger
(74) *Attorney, Agent, or Firm* — Mark Levy; Hinman, Howard & Kattell, LLP

(57) ABSTRACT

An automated vacuum carton lifter has a movable chassis with at least one vacuum cup mounted thereon, oriented so as to provide for gripping the carton or box from one of its vertical sides. A slack cable sensor used to turn on and off a vacuum. Alternatively, an air valve with an associated lever can be used, wherein the valve is depressed when the apparatus engages the carton or box. A vacuum generator is operatively connected to the vacuum cup(s). A device is provided for lifting and lowering the carton or box, the device having a cable slidably mounted to an air cylinder-operated carriage retained by a track; the device being movable to a position at the balance point of the carton or box. An adjustable control handle is provided and is associated with a force transducer that controls the lifting and lowering device. A microprocessor-based controller is operatively connected to a slack cable sensor, the vacuum generator, and the device for lifting and lowering the carton or box.

16 Claims, 4 Drawing Sheets

VACUUM-ASSISTED CARTON OR BOX LIFTER

RELATED PATENT APPLICATION

The present patent application is related to U.S. provisional patent application Ser. No. 61/673,427 filed Jul. 19, 2012, and claims the priority date thereof.

FIELD OF THE INVENTION

The invention pertains to material handling devices and, more particularly, to a microprocessor-controlled, semi-automated vacuum carton or box lifter that positions a lifting cable at the balance point of a carton or box for vertical and horizontal movement thereof, gripping the carton or box from the side instead of customarily from the top.

BACKGROUND OF THE INVENTION

Physically stacking cartons or boxes that weigh up to 50 lbs. (23 kg) on a pallet for long periods of time can cause great strain to the human body. Certain devices assist an operator in lifting and stacking such cartons or boxes; however, they are usually cumbersome and ergonomically unfriendly. They also usually lift cartons or boxes from the top where the tape or glue seal is subject to failure. What is needed is a semi-automated, vacuum-assisted transport device capable of picking the item up from the side and facilitating effortless vertical and horizontal movement of the cartons or boxes.

U.S. Pat. No. 4,557,659 for DEVICE FOR SUPPORTING AND HANDLING LOADS BY MEANS OF VACUUM OPERATED SUCTION PADS granted to Scaglia on Dec. 10, 1985 discloses a device that can be applied to a lifting and/or transporting unit for the controlled support of loads by generating a vacuum in one or more suction pads. The device includes a vacuum gauge measuring the vacuum level in at least one of the suction pads and safely controlling movement of the device. A safety system prevents erroneous dropping of the suspended load. The suction pads for gripping the load can be mounted on a holding frame which can be changed and/or lengthened for accommodating various types of loads.

U.S. Pat. No. 5,431,469 for VACUUM LIFT DEVICE granted to Ohno, et al. on Jul. 11, 1995 discloses a vacuum lift device comprising a lift tube which is able to contract and expand in an upward and downward direction, and a lift tube expansion control valve controlling the opening areas of the atmospheric openings of the lift tube. A hovering control valve controlling the flow area between the second atmospheric opening and the interior of the lift tube is provided. The lift tube expansion control valve is normally positioned at a position such that is completely covers the first atmospheric opening, and the second atmospheric opening is open to the outside space. At this time, the level of vacuum in the lift tube is adjusted by the hovering control valve so that an object to be lifted is maintained at a desired height.

U.S. Pat. No. 8,070,203 for METHOD FOR CONTROLLING VACUUM-OPERATED HOISTS AND LOAD PROTECTION DEVICE FOR VACUUM-OPERATED HOISTS granted to Schaumberger on Dec. 6, 2011 discloses a method for operating vacuum-operated hoists with at least one elastically deformable vacuum-operated lifting mechanism, with a controllable vacuum generator, and with at least one motorized lifting drive. A load detection device is used in order to detect the weight of a load picked up by the hoist. The load detection device generates a protection signal directly after detection of a load exceeding a predetermined tare weight of the hoist if the vacuum is insufficient to lift the load. The protection signal indirectly or directly deactivates the lifting drive with the aid of a switch-off control and/or prevents further lifting of the load if an insufficient vacuum or no vacuum is present when an increased load is detected and lifting begins.

U.S. Pat. No. 6,634,621 for LIFTING DEVICE AND A METHOD FOR LIFTING BY USING THE SAME granted to Keith on Oct. 21, 2003 discloses a lifting device for lifting and moving objects with minimal effort and a method for using the same. The lifting device has a cable attachable to an object and a handle on the cable. Sensors in the handle may sense vertical pressure exerted on the handle and may put out a current to a variable-speed motor in a housing of the lifting device. The motor may release or may retrieve the cable at a speed dependent upon the amount of pressure applied, thereby raising or lowering the object. Pressure of three to five pounds is sufficient to lift any object. The operator may move the object in any direction up to a radius determined by the length of the cable from the object to the housing. The housing may have an upper portion that may slide forward relative to a lower portion, lengthening the radius of movement allowed to the operator.

It would be advantageous to provide a semi-automated device for lifting and transporting cartons or boxes.

It would also be advantageous for such a device to be use a vacuum to grip and lift the carton or box from the side.

It would further be advantageous for such a device to hang in a level position when empty and automatically position a lifting cable at the balance point of a carton or box as it is lifted.

It would also be advantageous for such a device to be self-balancing for any size or weight carton or box being picked up and transported.

It would further be advantageous for such a device to be capable of moving a carton or box with very low force (e.g., less than 5% of the total weight) both vertically and horizontally, along the X-, Y-, and Z-axes.

It would further be advantageous for such a device to include a retractable guard to protect the delicate vacuum cups from damage and wear and tear during repeated use.

It would also be advantageous for such a device to be able to detect the slack lifting cable caused when the device rests on the carton or box and use this signal to turn the vacuum on and off.

SUMMARY OF THE INVENTION

In accordance with the present invention there is provided an automated vacuum carton or box lifter. A movable chassis has at least one vacuum cup mounted thereon. A sensor detects the slack lifting cable state present when the lifter is placed against and resting on the carton or box and for sending an electrical signal to a controller that turns on the vacuum. A vacuum generator is operatively connected to the vacuum cup(s). An electric actuator is provided for lifting and lowering the carton or box, the actuator having a cable slidably mounted to an air cylinder-operated carriage retained by a track; the device being movable to a position at the balance point of the carton or box. The correct balance point is determined by a level switch which commands the cylinder to move the lifting point until a level state is obtained. The vertical lifting motion of the device is controlled by a force transducer in the handle that detects even small amounts of pressure applied to the handle by the operator. The handle consists of an elongated oval with its horizontal axis of connection to the device being adjustable. These features collectively provide a wide range of reach for the operator from the floor to more than 100 inches high. A retractable guard is provided around the perimeter of the vacuum cup(s), automatically retracting to expose the cups to the carton or box when the vacuum is turned on. A Programmable Logic Controller (PLC) is operatively connected to the handle force transducer, slack cable sensor, level switch, vacuum generator, and actuator for lifting and lowering the carton or box.

BRIEF DESCRIPTION OF THE DRAWINGS

Various objects, features, and attendant advantages of the present invention will become more fully appreciated as the same becomes better understood when considered in conjunction with the accompanying figures, in which like reference characters designate the same or similar parts throughout the several views, and wherein.

DETAILED DESCRIPTION OF THE PREFERRED EMBODIMENT

In accordance with the present invention there is provided an automated vacuum carton or box lifter. A movable chassis has at least one vacuum cup mounted thereon. A sensor detects the slack lifting cable state present when the lifter is placed against and resting on the carton or box and sends an electrical signal to a controller, turning on the vacuum. A vacuum generator is operatively connected to the vacuum cup(s). An electric actuator is provided for lifting and lowering the carton or box, the actuator having a cable slidably mounted to an air cylinder-operated carriage retained by a track; the device being movable to a position at the balance point of the carton or box. The correct balance point is determined by a level switch which commands the cylinder to move the lifting point until a level state is obtained. The vertical lifting motion of the device is controlled by a force transducer in the handle that detects even small amounts of pressure applied to the handle by the operator. A retractable guard around the perimeter of the vacuum cup(s) automatically retracts, exposing the cups to the carton or box when the vacuum is turned on. A controller is operatively connected to the handle force transducer, slack cable sensor, level switch, vacuum generator, and actuator for lifting and lowering the carton or box.

The lifter is designed to provide means for an operator to lift and move cartons or boxes with very low force and without repeatedly pulling levers and pushing buttons to operate the device. The goal is to make the process as fluent and natural as possible, as if the operator were still stacking manually in a zero gravity field, without feeling the weight of the box.

The apparatus uses vacuum generator technology to grip the carton or box. Customarily, when lifting boxes using vacuum, the preferred surface of the box for lifting is the top. However, in many cases the top of the box is not taped securely or at all. Lifting these cartons from the top can result in dropping them prematurely and/or damaging them.

The other common way to grip a carton or box with vacuum is by two sides, most commonly two opposite sides. There are also cases where two adjacent sides are used. When stacking and nesting many boxes together on a pallet, this becomes impractical because part of the apparatus may interfere with adjoining boxes.

The inventive apparatus simply grips a carton or box on one side only, eliminating any stress on the top seal and allowing the operator to place cartons snugly against each other.

The invention uses a combination of software and electronic hardware devices. Four actions are automated on the lifter:

- Automatically engaging the vacuum to lift the carton or box;
- Automatically extending and retracting the vacuum cup guard;
- Automatically maintaining a level orientation when empty and with a carton engaged; and
- Automatically releasing the carton or box.

Figure 1:
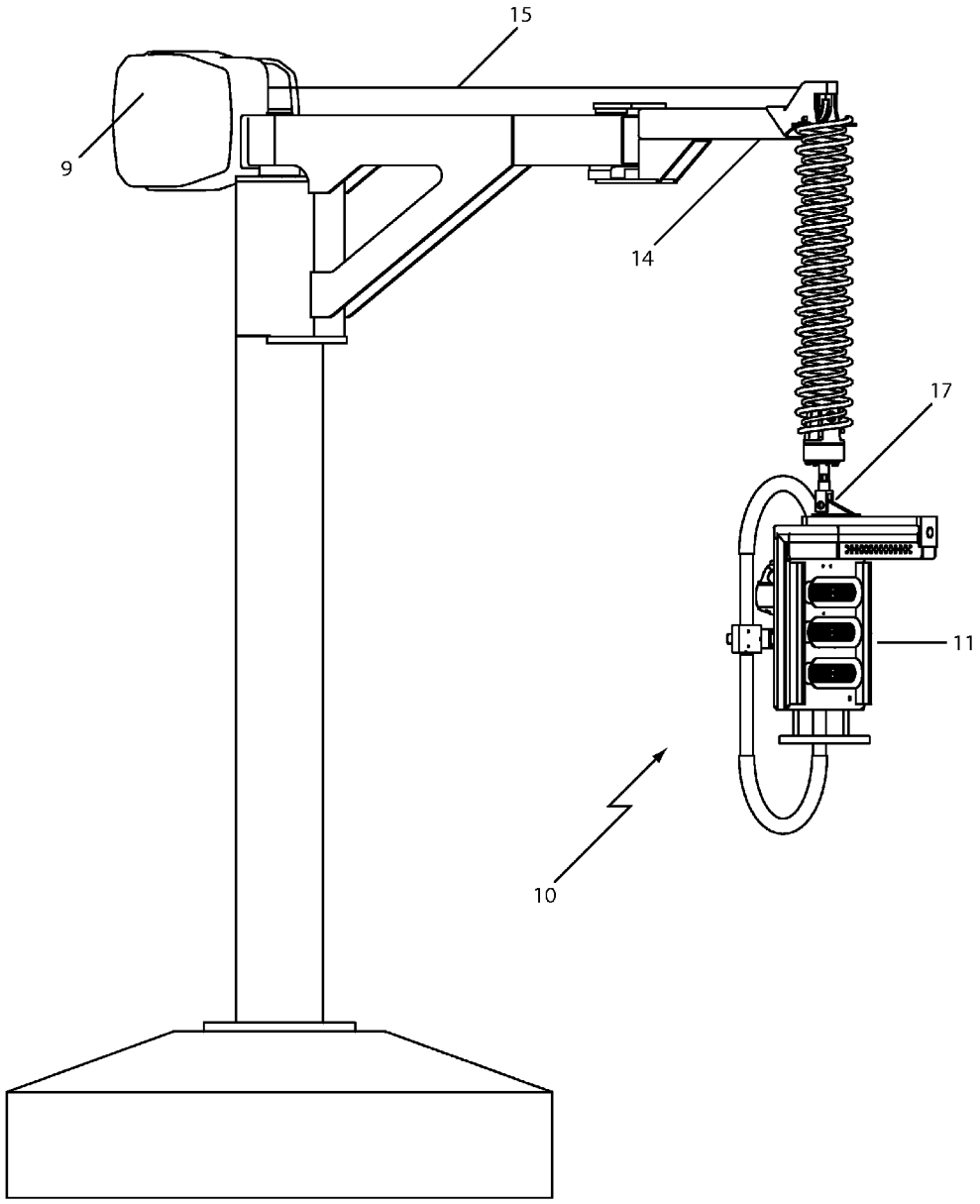
FIG. 1 is a perspective view of the automated vacuum carton or box lifter and associated lifting/lowering device in accordance with the invention.
Figure 2:
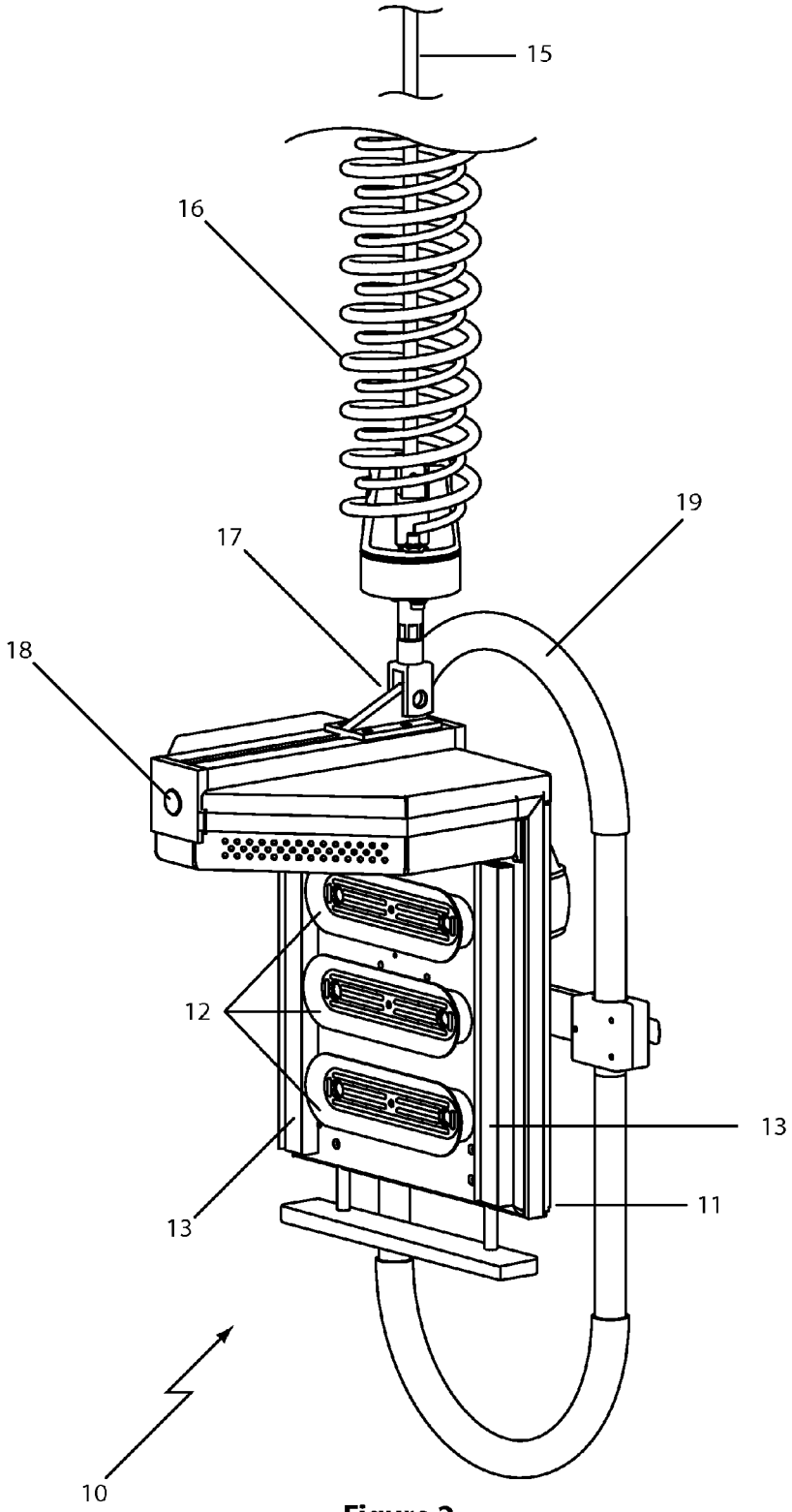
FIG. 2 is a close-up perspective view of the automated vacuum carton or box lifter.

Referring now to FIGS. 1 and 2, a lifter 10 has an L-shaped frame 11 with one or more vacuum cups 12 mounted in the center of the vertical surface. Vacuum cups 12 may be disposed linearly as shown or in a two-dimensional matrix or pattern. A retractable guard 13 is positioned around the periphery of the vacuum cups 12 to reduce wear of the extremities of each cup 12 (as hereinbelow described in more detail) when lifter 10 is slid over cartons or boxes.

In the preferred embodiment shown, lifter 10 is suspended from an articulated mechanical arm 14 by an extendable steel lifting cable 15 connected to an electric actuator 9. A coiled electrical cord and air supply hose 16 provide electrical control and compressed air to lifter 10.

Lifting cable 15 is attached to lifter via a small carriage 17 that slides in a track. While empty, an air cylinder 18 attached to carriage 17 positions carriage at the balance point of the apparatus. When the vacuum is turned on, it simultaneously activates a solenoid controlling the balancing cylinder. Once a carton begins to lift, cylinder 18 shifts the carriage towards the center of gravity of the box until a level state is achieved. Thus lifter and load are always level and square.

Figure 3:
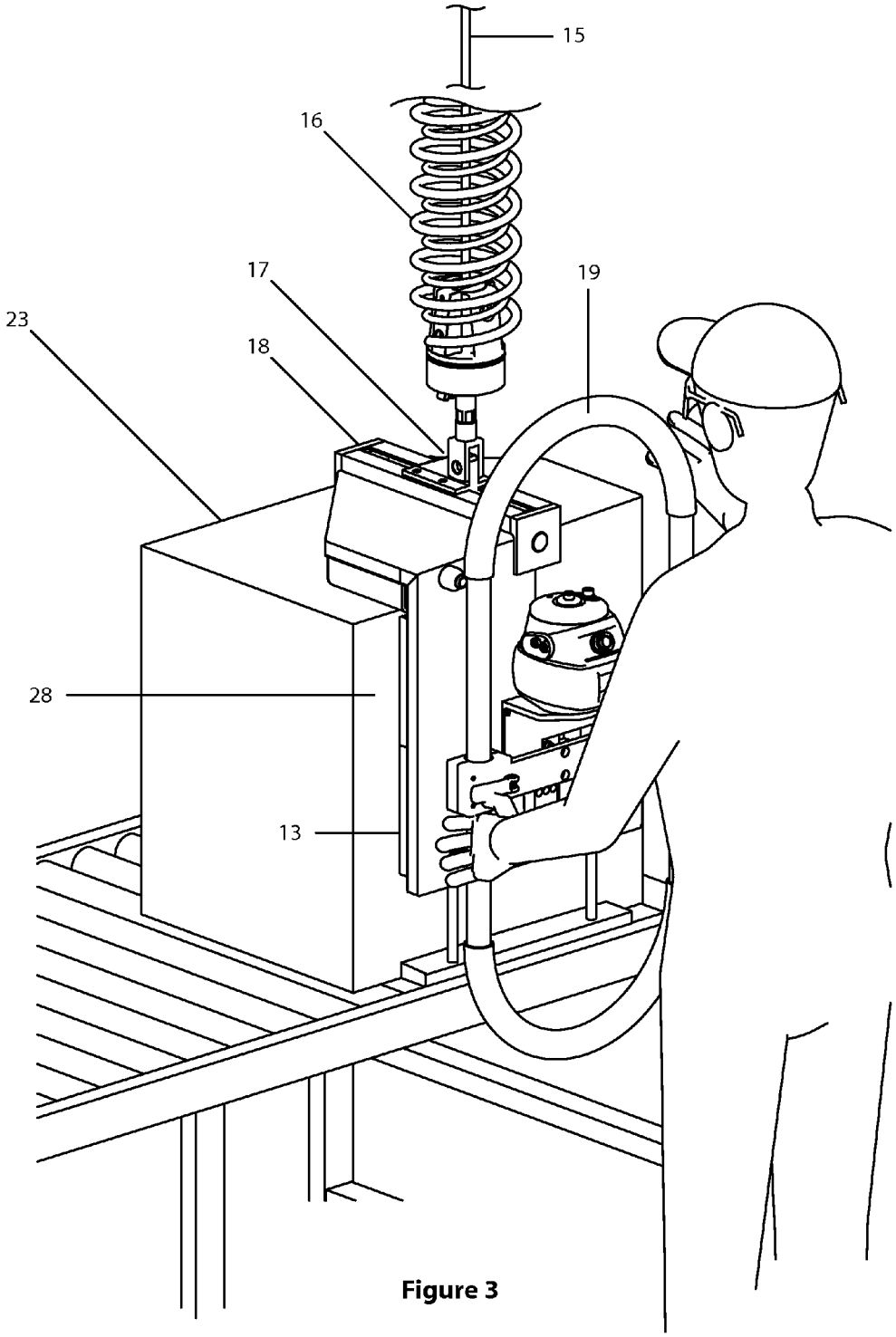
FIG. 3 depicts the carton or box lifter shown in FIGS. 1 and 2 in position proximate a carton or box to be moved.
Figure 4:
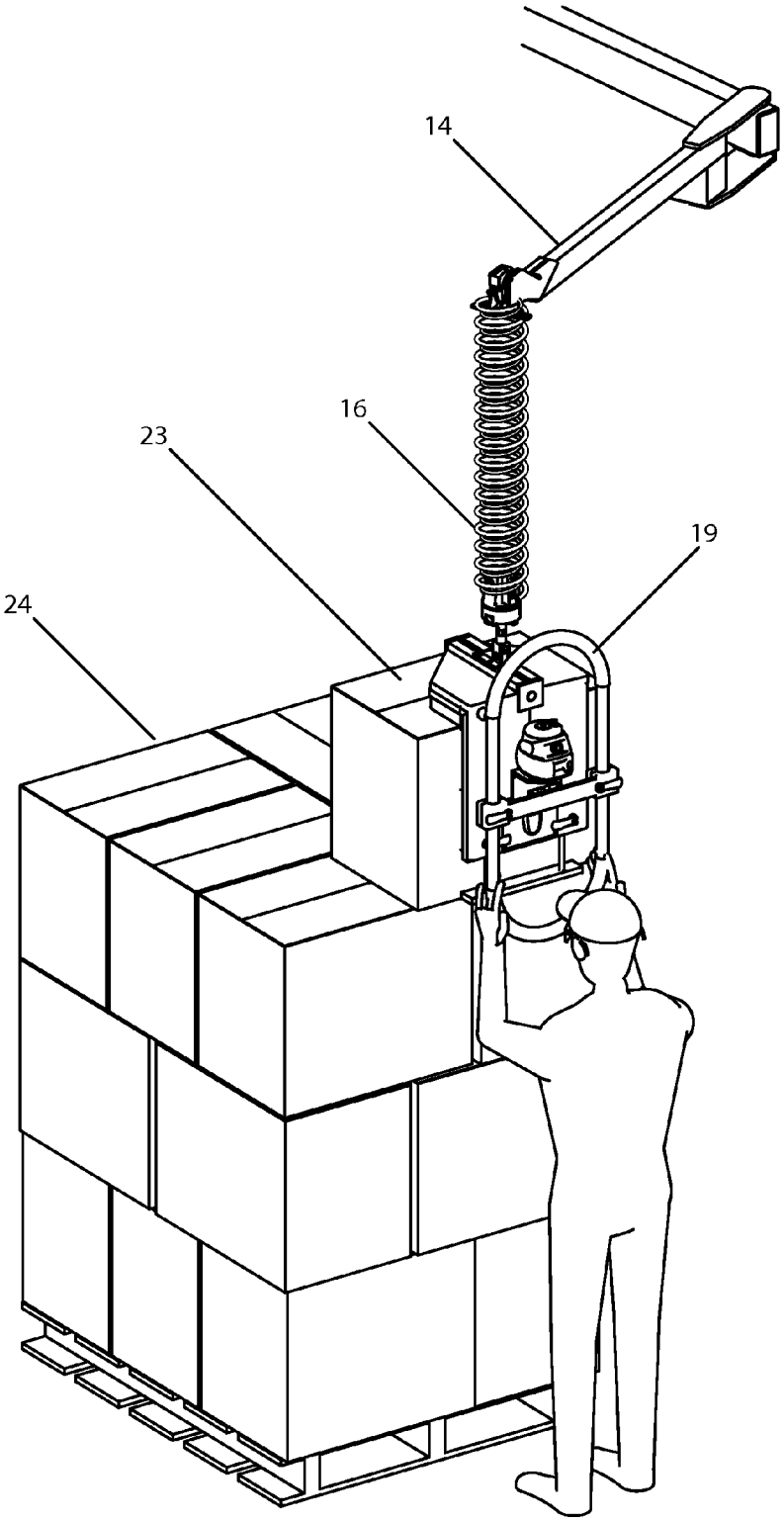
FIG. 4 depicts the carton or box lifter and lifting/lowering device mechanical arm placing a carton or box.

Referring now to FIGS. 3 and 4, as an operator places lifter 10 on a carton or box 23, an internal slack cable sensing device (not shown) detects the slack cable state caused by the weight of lifter being supported by carton 23 and sends an electrical signal to an internal air solenoid valve (not shown) via an internal microprocessor-based controller, such as manufactured by B&R Automation Company as Model No. 7CP474.60-2, for example. Valve 24 solenoid is activated, allowing a supply of air to flow through an internal Venturi-style vacuum generator, such as manufactured by Vaccon Company as Model No. VP80-200M, for example. The resulting vacuum pressure generated at the vacuum cups(s) grips the carton or box 23 against the vertical face 28 of lifter 10. The carton is now fully supported by lifter due to the clamping force between the vertical box surface 23 and vacuum cups 12. As the operator applies a small amount of upward pressure on lifter handle 19, an internal force transducer (not shown) converts the detected force to a proportional electrical signal that is transmitted to the internal microprocessor which, in turn, commands electric actuator 9 to raise the cable 15. As the carton begins to lift up, its off-center weight added to lifter creates an imbalance such that lifter and carton begin to tilt away from the operator.

The resulting imbalance state is sensed by an internal level switch 40, also known as an inclinometer, such as a self-balancing switch manufactured by Turck Company, as Part No. B1N360V-Q20L60-2UP6×3-H1151, for example. Switch 40 can be located anywhere on the apparatus as long as switch is in its neutral, level position when lifter 10 is in its unloaded state. Inclinometer 40 is a single- or multi-axis switch with two outputs per axis. Switch 40 is part of an electrical circuit that, when out of level, sends an electrical signal to air valve, firing the auto balance cylinder in the direction required to level the lifter 10. Once level, switch 40 returns to its neutral state and cuts power to its outputs, stopping motion of the cylinder. Specifically, switch 40 sends a signal to microprocessor, which then activates solenoid value that controls the balance cylinder 18. Balance cylinder moves carriage 17, which moves the connected cable 15 towards the new center of gravity of the load until a new level state has been achieved.

Although logic for operating the system in accordance with the preferred embodiment resides in a programmable logic controller (PLC) located inside the remote lifting actuator and is electrically connected to various sensors, it should be understood that such PLC and the associated logic could be located on lifter 10 itself.

Returning to FIG. 2, in the preferred embodiment, the retractable vacuum cup guard 13 is achieved with an inflatable rubber seal mounted in a metal channel located on either side of the vacuum cups 12. The axially cylindrical geometry of the seal material is such that when inflated by air pressure it protrudes past the plane of the vacuum cups, protecting them from contact with the carton. Inflatable seal 13 is inflated when vacuum to the plurality of vacuum cups 12 is turned off, extending inflatable seal 13 beyond the outer extension of each vacuum cup 12. Conversely, the inflatable seals 13 are deflated at the same time vacuum cups 12 are turned on, thus reversing the extension and allowing the vacuum cups 12 to engage the carton. The control of the inflatable seals in through the same control circuit as the vacuum generators.

Referring again to FIG. 4, once the carton or box 23 is lifted, an operator guides the package 23 using handle 19. When in the desired position, the operator lowers the box 23 until it rests on (or is supported by) a stable surface such as a stack of cartons 24 or some other surface such as the floor or a pallet. The slack cable sensor then detects the slack cable state and sends an appropriate electrical signal to air solenoid valve, turning off the vacuum and releasing the box 23 and again engaging the inflatable seal. The cycle then repeats again for each carton to be handled.

Lifter 10 can support and is balanced while gripping a carton or box 23 from an empty state up to a 50 lb. load in the preferred embodiment. Of course, heavier loads can be transported with suitably stronger components. Lifter 10 may be used with an intelligent lifting/lowering device such as a Gorbel Easy Arm/G-Force lifting device. A load cell (not shown) can be integrated into lifter 10 or lifter 10 can use the load cell (not shown) already integrated into the G-Force crane.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A semi-automated vacuum carton or box lifter, comprising:

a) a movable chassis having an adjustable lifting handle mounted thereon and a plurality of vacuum cups mounted thereon oriented so as to provide for gripping the carton or box from one of its vertical sides, said plurality of vacuum cups forming a field thereof and having a perimeter, said lifter further comprising an inflatable seal disposed around or on either side of said perimeter of said vacuum cup field;

b) a vacuum generator operatively connected to said plurality of vacuum cups;

c) means for detecting a slack cable state and for generating an electrical signal representative thereof;

d) means for lifting and lowering a carton or box and controlling said function through a force transducer coupled to said adjustable lifting handle; and e) a controller operatively connected to said means for detecting the slack cable state, said vacuum generator, and said means for lifting and lowering said carton or box.

2. The semi-automated vacuum carton or box lifter in accordance with claim 1, wherein said means for lifting and lowering said carton or box comprises a slidable clevis mounted to an air cylinder-operated carriage retained by a track, said means for lifting and lowering a carton or box being movable to a position at the balance point thereof.

3. The semi-automated vacuum carton or box lifter in accordance with claim 2, further comprising a lifting cable operatively connected to said clevis.

4. The semi-automated vacuum carton or box lifter in accordance with claim 1, wherein said inflatable seal is inflated when vacuum to said plurality of vacuum cups is disabled, extending said inflatable seal beyond the outer extension of said plurality of vacuum cups.

5. The semi-automated vacuum carton or box lifter in accordance with claim 1, wherein said inflatable seal is deflated when vacuum to said plurality of vacuum cups is enabled, uncovering said outer extension of said plurality of vacuum cups.

6. The semi-automated vacuum carton or box lifter in accordance with claim 1, further comprising a lift point adjusting cylinder connected to said movable chassis.

7. The semi-automated vacuum carton or box lifter in accordance with claim 6, further comprising a self-balancing switch for controlling said lift point adjusting cylinder.

8. The semi-automated vacuum carton or box lifter in accordance with claim 1, further comprising means for moving said carton or box pick horizontally.

9. The semi-automated vacuum carton or box lifter in accordance with claim 1, wherein said means for detecting the position of a carton or box comprises a sensor for detecting a slack state in the lifting cable.

10. The semi-automated vacuum carton or box lifter in accordance with claim 9, wherein said vacuum to said plurality of vacuum cups is disabled when said controller detects said slack state of said lifting cable, indicating a carton or box is supported by a floor or a platform on which it rests.

11. The semi-automated vacuum carton or box lifter in accordance with claim 1, further comprising a self-balancing switch for generating a signal to move the connected cable towards the new center of gravity of the load until a new level state has been achieved.

12. A method for lifting and transporting a carton or box, the steps comprising:

a) providing a movable chassis having a plurality of vacuum cups mounted thereon and oriented so as to provide for gripping the carton or box from a vertical side thereof;

b) providing an inflatable seal and inflating said seal when vacuum to a plurality of vacuum cups is disabled, extending said inflatable seal beyond the outer extension of said plurality of vacuum cups;

c) detecting the position of a carton or box to be moved and generating an electrical signal representative thereof; and d) controlling the lifting and lowering of a carton or box by receiving said electrical signal and activating a vacuum pump connected to said plurality of vacuum cups.

13. The method for picking and transporting a carton or box in accordance with claim 12, wherein said controlling the lifting and lowering a carton or box step (d) is performed with a slidable clevis mounted to an air cylinder-operated carriage retained by a track, and moving said carton or box is performed by determining a position at the balance point thereof with the use of a self-balancing switch.

14. The method for picking and transporting a carton or box in accordance with claim 13, the steps further comprising providing a lifting cable operatively connected to said slidable clevis.

15. The method for picking and transporting a carton or box in accordance with claim 14, the steps further comprising detecting a slack state in said lifting cable.

16. The method for picking and transporting a carton or box in accordance with claim 13, the steps further comprising activating said self-balancing switch when a plurality of vacuum cups contact said carton or box.

* * * * *